US005913627A

United States Patent [19]

Freeman et al.

[11] Patent Number: 5,913,627

[45] Date of Patent: Jun. 22, 1999

[54] GUIDE AND SUPPORT STRUCTURE FOR A MAILING MACHINE

[75] Inventors: Gerald C. Freeman, Norwalk; Norman R. Lilly, Shelton, both of Conn.

[73] Assignee: Pitney Bowes Inc., Stamford, Conn.

[21] Appl. No.: 08/989,126

[22] Filed: Dec. 11, 1997

[51] Int. Cl.[6] ..... B41J 13/24

[52] U.S. Cl. ..... 400/630; 400/642

[58] Field of Search ..... 400/630, 631, 400/632, 633, 634, 635, 642; 101/91, 96, 227, 232; 198/844.1

[56] References Cited

U.S. PATENT DOCUMENTS

| | | | |
|---|---|---|---|
| 2,332,152 | 10/1943 | Knauer | 226/143 |
| 2,533,317 | 12/1950 | Hanson | 101/227 |
| 4,170,350 | 10/1979 | Conti | 101/232 |
| 4,746,234 | 5/1988 | Harry | 101/91 |
| 5,083,879 | 1/1992 | Sato et al. | 400/630 |
| 5,136,307 | 8/1992 | Uchida et al. | 400/642 |
| 5,162,905 | 11/1992 | Eriksson et al. | 400/642 |
| 5,196,083 | 3/1993 | Baker et al. | 156/364 |
| 5,339,733 | 8/1994 | Malin | 101/91 |
| 5,465,662 | 11/1995 | Keung et al. | 101/91 |
| 5,594,486 | 1/1997 | Kiyohara | 400/630 |
| 5,740,728 | 4/1998 | DeBarber et al. | 101/91 |
| 5,765,475 | 6/1998 | Salomon | 101/91 |

*Primary Examiner*—Eugene Eickholt

*Attorney, Agent, or Firm*—Angelo N. Chaclas; Melvin J. Scolnick

[57] ABSTRACT

Mailing machine for feeding a mailpiece and printing a postal indicia thereon. The mailing machine includes: a drive assembly for feeding the mailpiece in a path of travel, a printer located adjacent to the path of travel to define a print station, the printer for printing the postal indicia on the mailpiece as the mailpiece is fed through the print station; a wall parallel to the path of travel for registering a top edge of the mailpiece; a shield located in the print station for registering a top surface of the mailpiece, the shield having a suitable opening to allow the printer to print on the top surface of the of the mailpiece; and a guide assembly for biasing the top surface of the mailpiece against the shield. The guide assembly including a first support rail including a first top guide surface and a second top guide surface vertically spaced apart from the first top surface, the first support rail spaced apart transverse to the path of travel from the wall and a device for biasing the first support rail upward so that the mailpiece is fed between the shield and the first support rail as the mailpiece is fed through the print station so that a first type of mailpiece having a width greater than a threshold value contacts the first top guide surface and a second type of mailpiece having a width less than the threshold value contacts the second top guide surface.

7 Claims, 4 Drawing Sheets

GUIDE AND SUPPORT STRUCTURE FOR A MAILING MACHINE

FIELD OF THE INVENTION

This invention relates generally to mailing machines. More particularly, this invention is directed to a guide and support structure for handling tapes and envelopes as they are fed through a print station of a mailing machine.

BACKGROUND OF THE INVENTION

Mailing machines are well known in the art. Generally, mailing machines are readily available from manufacturers such as Pitney Bowes Inc. of Stamford, Connecticut. Mailing machines often include a variety of different modules or sub-systems that automate the processes of producing mailpieces where each module performs a different task on the mailpiece. The typical mailing machine includes the following modules: singulator (separating the mailpieces one at a time from a stack of mailpieces), scale, moistener (wetting and sealing the gummed flap of an envelope or tape), printer (applying evidence of postage), meter (accounting for postage used) and stacker (stacking finished mailpieces). However, the exact configuration of each mailing machine is particular to the needs of the user. Customarily, the mailing machine also includes a transport apparatus that feeds the mailpieces in a path of travel through the successive modules of the mailing machine.

In some mailing machines it is desirable to print postal indicia on both envelopes and tapes. The tapes being used when the package or envelope to be mailed is oversized or too large to be fed through the mailing machine. Thus, the postal indicia is printed on a tape and then the tape is adhered to the oversized item. Accordingly, the moistener module may be required to wet both envelope flaps and tapes.

One mailing machine that includes an ink jet printer for printing on both envelopes and tapes is described in U.S. Pat. No. 5,456,607 which is assigned to the assignee of the present invention. In this mailing machine, the envelope is fed along a first path while the tape is fed along a second path substantially parallel to the first path. Thus, to effect printing the ink jet printer repositions between the between the first path and the second path depending upon whether an envelope or a tape, respectively, is being printed upon.

Although this mailing machine works well, it is not appropriately suited for all mailing machine customers. For example, since this mailing machine includes separate envelope and tape feed paths and must accommodate the repositioning of the printer in a direction transverse to the feed paths, the overall foot print of this mailing machine is large. Some customers desire mailing machines with smaller footprints due to the high cost of office space.

Other mailing machines such as those described in U.S. Pat. Nos. 2,332,152 and 2,533,317, assigned to the assignee of the present invention, provide for printing on both envelopes and tape at a single print station. However, these mailing machines incorporate rotary drum die printing and include elaborate transport structure which is expensive to produce, operate and maintain.

Therefore, there is a need for a mailing machine that utilizes a single print station for printing on both envelopes and tapes in an economical manner. In this way, the drawbacks associated with the mailing machines described above may be overcome in a cost effective manner to produce a new mailing machine that is better suited to the needs of certain customers.

SUMMARY OF THE INVENTION

The present invention provides a single feed path for both envelopes and tapes. In accordance with the present invention, there is provided a mailing machine for feeding a mailpiece and printing a postal indicia thereon. The mailing machine includes: a drive assembly for feeding the mailpiece in a path of travel, a printer located adjacent to the path of travel to define a print station, the printer for printing the postal indicia on the mailpiece as the mailpiece is fed through the print station; a wall parallel to the path of travel for registering a top edge of the mailpiece; a shield located in the print station for registering a top surface of the mailpiece, the shield having a suitable opening to allow the printer to print on the top surface of the of the mailpiece; and a guide assembly for biasing the top surface of the mailpiece against the shield. The guide assembly including a first support rail including a first top guide surface and a second top guide surface vertically spaced apart from the first top surface, the first support rail spaced apart transverse to the path of travel from the wall and a device for biasing the first support rail upward so that the mailpiece is fed between the shield and the first support rail as the mailpiece is fed through the print station so that a first type of mailpiece having a width greater than a threshold value contacts the first top guide surface and a second type of mailpiece having a width less than the threshold value contacts the second top guide surface.

Therefore, it is now apparent that the present invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Figure 1:
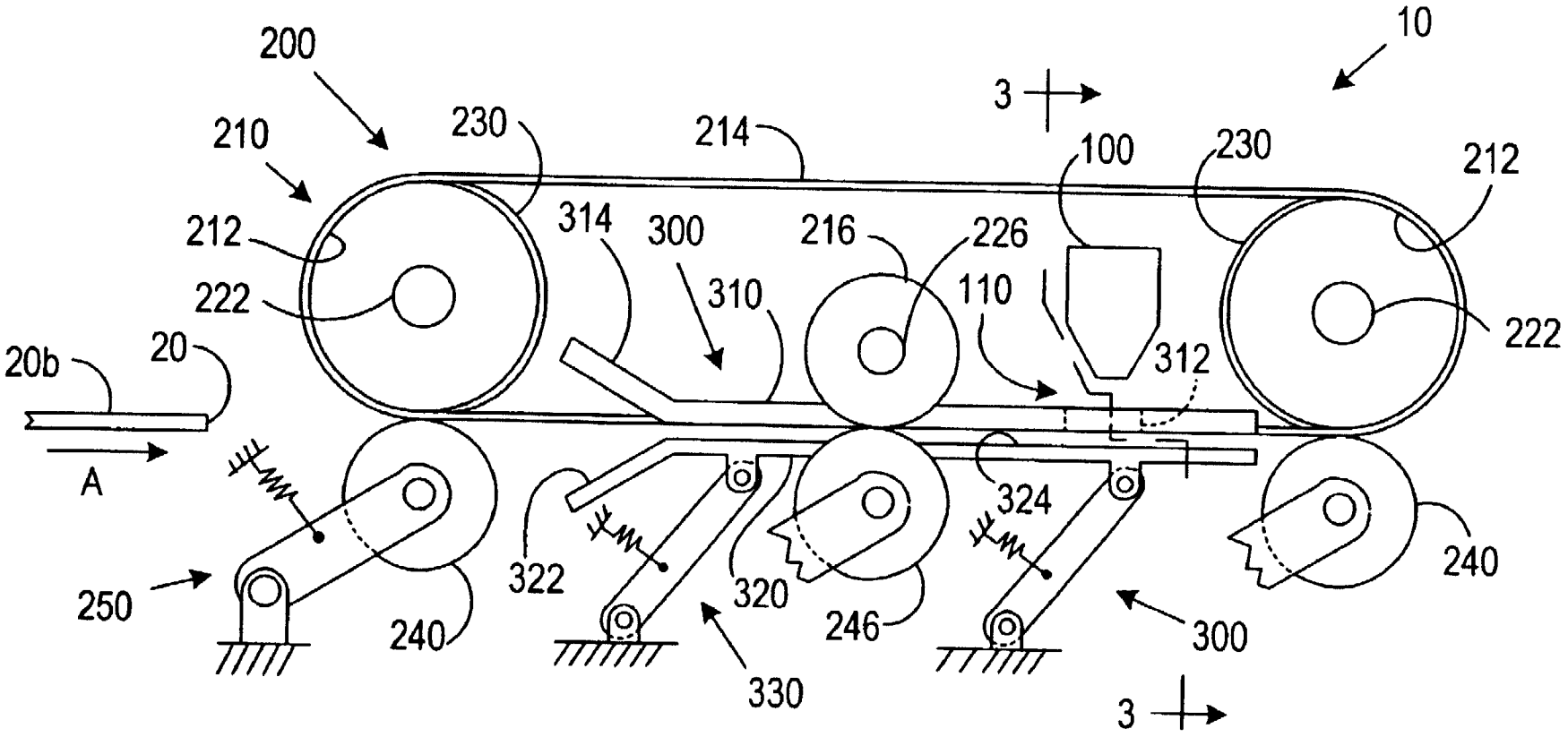
FIG. 1 is a simplified schematic of a front elevational view of a mailing machine in accordance with the present invention.

Referring to FIG. 1, a simplified view a mailing machine 10 is shown. For the sake of clarity, only those aspects of the mailing machine 10 that are necessary for an understanding of the present invention are shown.

The mailing machine 10 includes a printer module 100 and a transport assembly 200 for feeding a mailpiece 20 (envelope, postcard, tape or the like) through the mailing machine 10 in a path of travel as indicated by the arrow A. The printer module 100 is located adjacent to the path of travel so as to define a print station 110. As the mailpiece is fed through the print station 110, a postal indicia (not shown) is printed on the mailpiece 20. In the preferred embodiment, the printer module 100 is an ink jet printer. However, any suitable printing technology, such as transfer printing or electrophotographic printing, could be used in conjunction with the present invention.

Figure 2:
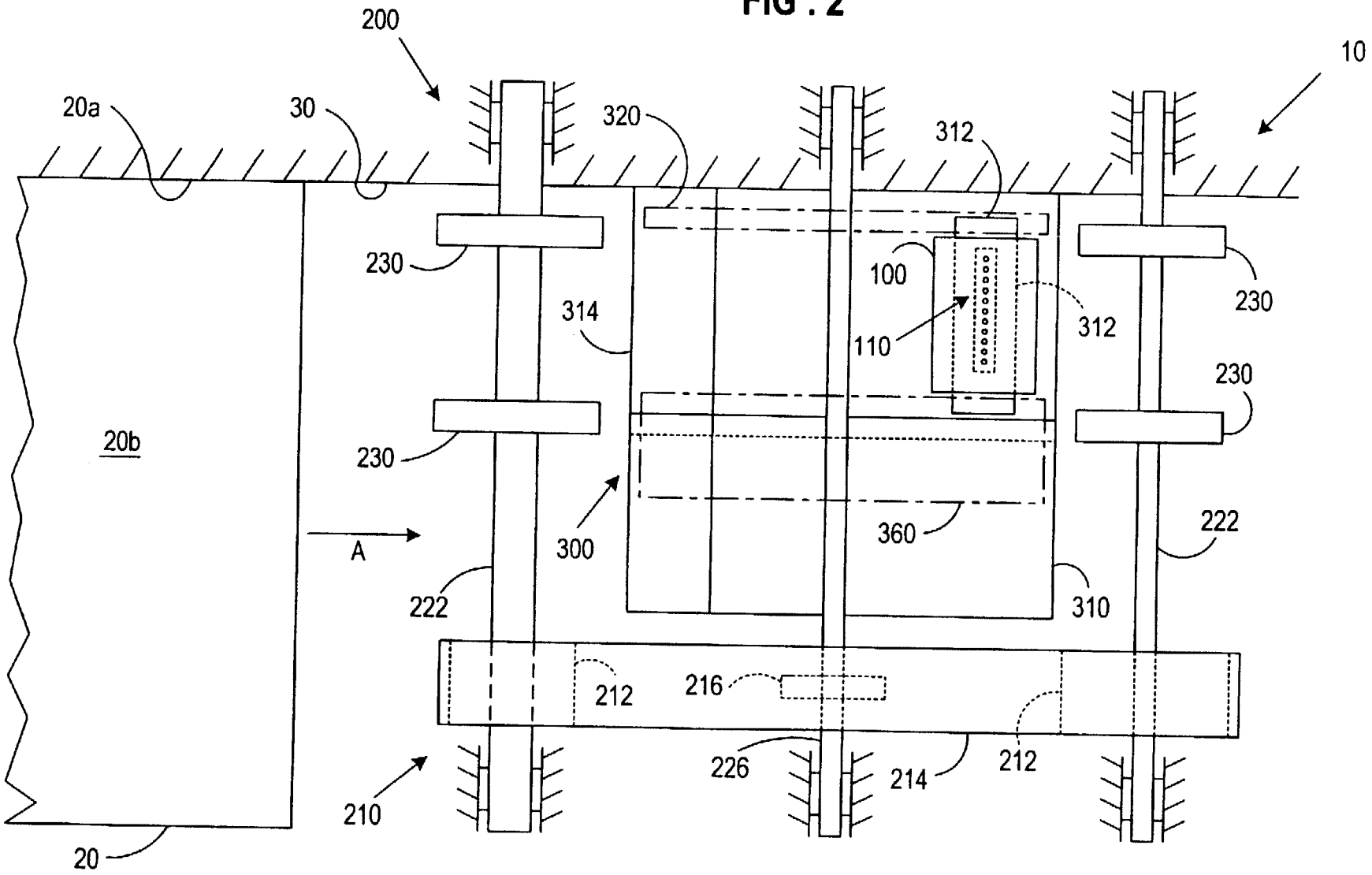
FIG. 2 is a simplified schematic of a plan view of the mailing machine in accordance with the present invention.

Referring to FIGS. 1 and 2, the transport assembly 200 includes a drive assembly 210 for feeding the mailpiece 20 and a guide assembly 300 for supporting the mailpiece 20 as it is fed through the print station 110. Generally, the drive assembly 210 feeds the mailpiece 20 in the path of travel so that the top edge 20*a* of the mailpiece 20 is butted up against a registration wall 30. In this manner, the placement of the postal indicia with respect to the top edge 20*a* of the mailpiece 20 may be accurately controlled. The drive assembly 210 includes an endless belt 214 extending around a pair of pulleys 212 that are in turn fixably mounted to a pair of shafts 222, respectively. The shafts 222 are rotatably mounted to any suitable structure, such as a frame (not shown), by any conventional means. Operatively coupled to one of the shafts 222 is a motor (not shown) for causing the shafts 222 to rotate. An idler pulley 216 is fixably mounted to a shaft 226 that is rotatably mounted to any suitable structure, such as a frame (not shown), by any conventional means. The idler pulley 216 is located approximately midway between the pair of pulleys 212 so as to provide better control over the endless belt 214. Also fixably mounted on the shafts 222 are a plurality of feed rollers 230 that rotate in kind with the pair of pulleys 212.

The drive assembly 210 further includes appropriate structure for keeping the mailpiece 20 in intimate contact with the driven elements of the drive assembly 210. A plurality of normal force rollers 240 are mounted in opposed relationship to the plurality of feed rollers 230, respectively. The plurality of normal force rollers 240 are spring loaded upward so that as the mailpiece 20 passes between the plurality of feed rollers 230 and the plurality of normal force rollers 240, the mailpiece 20 is presses upward into intimate contact with the plurality of feed rollers 230. For the sake of clarity, only one of the plurality of normal force rollers 240 has been shown with a suitable mounting structure 250. Additionally, a normal force roller 246 is mounted, in similar fashion as the plurality of normal force rollers 240, opposite to the idler pulley 216 to keep the mailpiece 20 in intimate contact with the endless belt 214.

The guide assembly 300 includes a registration shield 310, an inner support rail 320 proximate to the registration wall 30 and an outer support rail 360 spaced apart from the registration wall 30. In FIG. 1, the outer support rail 360 is hidden from view and is not shown. In FIG. 2, for the sake of clarity, only the outlines of the inner support rail 320 and the outer support rail 360 are shown in phantom lines. Referring to FIGS. 1, 2, 3*a* and 3*b*, the registration shield 310 is fixably mounted along the path of travel to any suitable structure. The plurality of normal force rollers 240, the idler pulley 216, the inner support rail 320 and the outer support rail 360 work cooperatively to bias the top surface 20*b* of the mailpiece 20 against the registration shield 310. Generally, the registration shield 310 operates to control the gap between the top surface 20*b* of the mailpiece 20 and the printer module 100 so that a quality printed image may be achieved. In the area of the print station 110, the registration shield 310 includes an opening 312 that is in vertical alignment with the printer module 100 so that printing may occur on the top surface 20*b* of the mailpiece 20 as it passes through the print station 110. Upstream in the direction of travel from the print station 110, the registration shield 310 includes a lead-in flange 314 to facilitate accepting the incoming mailpiece 20 without any buckling.

Referring to FIGS. 1 and 2, the inner support rail 320 and the outer support rail 360 are located opposite to the registration shield 310 so that the mailpiece 20 passes between the registration shield 310 and the inner support rail 320 and the outer support rail 360. The inner support rail 320 includes a lead-in flange 322 to facilitate accepting the incoming mailpiece 20 without any buckling. Similarly, the outer support rail 360 also includes a is lead-in flange (not shown). The inner support rail 320 is spring biased upward toward the registration shield 310 by any suitable structure 330. Once again, the outer support rail 360 is similarly spring biased upward by any suitable structure (not shown). Thus, the inner support rail 320 and the outer support rail 360 separately and independently spring biased upward.

Figure 3A:
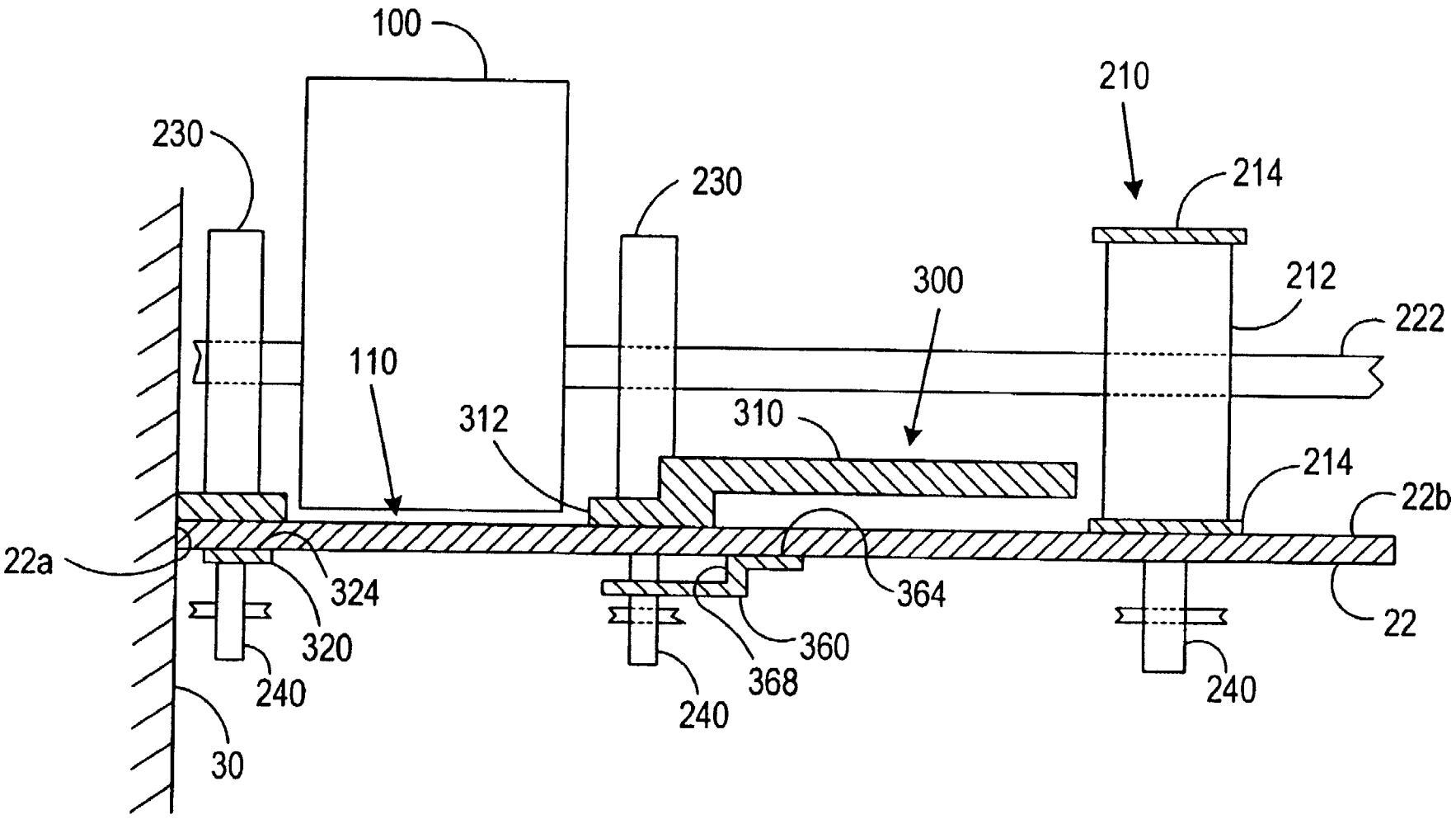
FIG. 3*a* is a simplified schematic of a left side elevational cross sectional view, taken along lines 3—3 as shown in FIG. 1, of the mailing machine feeding an envelope in accordance with the present invention.

With the basic structure of the mailing machine 10 described as above, an overview of the operational characteristics along with further structural details will now be described with reference to FIGS. 1, 3*a* and 3*b*. FIG. 3*a* being a side cross sectional view, taken along lines 3—3 as shown in FIG. 1, of the mailing machine 10 with an envelope 22 in the print station 110. Referring primarily to FIG. 3*a* while recalling the structure of FIG. 1, the envelope 22 represents a first type of mailpiece 20 that has a width, as measured in a direction transverse to the path of travel, that is larger than a threshold value. As described above with respect to the mailpiece 20, a top edge 22*a* of the envelope 22 travels along the registration wall 30 while a top surface 22*b* of the envelope 22 is biased against the registration shield 310.

Those skilled in the art will recognize that the plurality of normal force rollers 240, the idler pulley 216, the inner support rail 320 and the outer support rail 360 all deflect to accommodate the thickness of the envelope 22. Thus, the envelope 22 rides along a top surface 324 of the inner support rail 320 and a first top surface 364 of the outer support rail 360 as it is fed through the print station 110 by the plurality of feed rollers 230 and the endless belt 214.

Figure 3B:
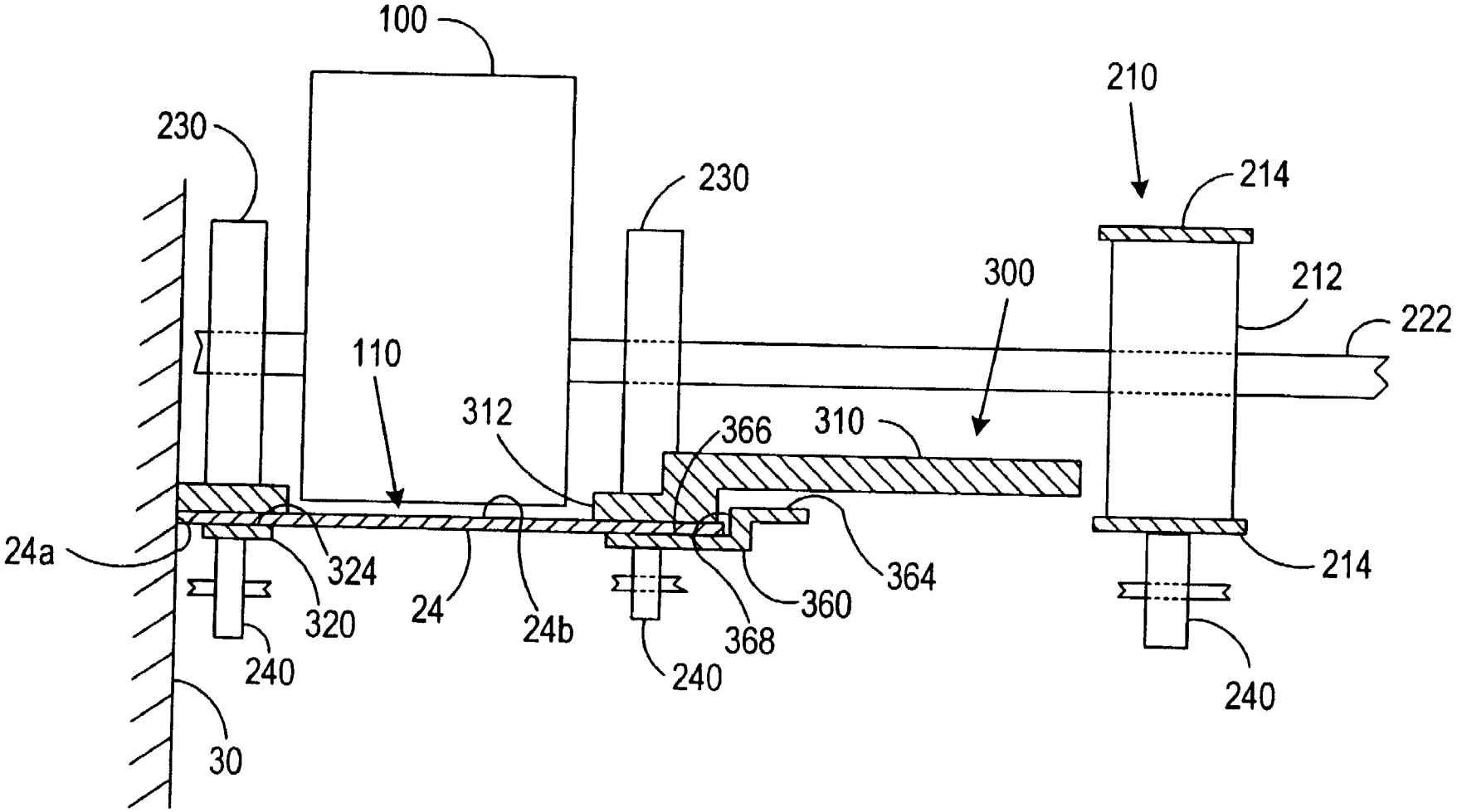
FIG. 3*b* is a simplified schematic of a left side elevational cross sectional view, taken along lines 3—3 as shown in FIG. 1, of the mailing machine feeding a tape in accordance with the present invention.

FIG. 3*b* is a side cross sectional view, taken along lines 3—3 as shown in FIG. 1, of the mailing machine 10 with a tape 24 in the print station 110. Referring primarily to FIG. 3*b* while recalling the structure of FIG. 1, the tape 24 represents a second type of mailpiece 20 that has a width, as measured in a direction transverse to the path of travel, that is less than the threshold value. As described above with respect to the mailpiece 20, a top edge 24*a* of the tape 24 travels along the registration wall 30 while a top surface 24*b* of the tape 24 is biased against the registration shield 310. Those skilled in the art will recognize that the plurality of normal force rollers 240, the idler pulley 216, the inner support rail 320 and the outer support rail 360 all deflect to accommodate the thickness of the tape 24. Here again, the tape 24 rides along the top surface 324 of the inner support rail 320. However, unlike the envelope 22 as shown in FIG. 3*a*, the tape 24 rides along a second top surface 366 vertically spaced from the first top surface 364 of the outer support rail 360 as it is fed through the print station 110 by the plurality of feed rollers 230 because the tape 24 does not extend outward enough to reach the first top surface 364. Also, since the tape 24 does not extend outward to the endless belt 214, the endless belt 214 plays no part in feeding the tape 24.

The outer support rail 360 also operates to keep the tape 24 aligned with the registration wall 30. Because the tape 24 is often made of a thin paper strip with a gummed or adhesive backing, it does not have the rigidity of the envelope 22 and is often flimsy. Because the tape 24 is often narrow, typically having a width (as measured transverse to the path of travel) of about 1.75 inches, and often only of limited length of about 4.0 inches (as measured in the path of travel), it is more susceptible to skew due to less contact area with the drive assembly 210. Therefore, the tape 24 is more difficult to feed reliably with the top edge 24*a* of the tape 24 properly aligned against the registration wall 30. To assist in registering the top edge 24*a* of the tape 24, the outer support rail 360 includes a guide surface 368 that extends vertically upward from the second top surface 366. The guide surface 368 is spaced apart from the registration wall 30 to accommodate the width of the tape 24 while allowing for a small amount of clearance (about 0.300 to 0.060 inches). In this manner, the tape 24 is laterally captured between the registration wall 30 and the guide surface 368 without imparting any skew or buckling to the tape 24.

It should now be apparent to those skilled in the art that the guide surface 368 is utilized when the tape 24 is feed but not when the envelope 22 is fed. Since the tape 24 is of a predictable width as specified by the mailing machine manufacturer, the guide surface 368 may be appropriately spaced apart from the registration wall 30 to any predetermined dimension. On the other hand, the envelope 22 may be of any size depending upon the needs of the customer. Thus, it is more difficult to establish a guide surface for the envelope 22. However, the endless belt 214 feeds the envelope 22 and provides a sufficient contact area and frictional force to prevent the envelope 22 from skewing. Due to the small size of the tape 24, feeding with an endless belt is not practical because the belt cannot contact that portion of the tape 24 in the print station 110 or else a smudged printed image would result. Thus, all that is feeding the tape 24 are the plurality of feed rollers 230 that are positioned outside of the print station 110.

It should now be apparent to those skilled in the art that the present invention substantially addresses those drawbacks and problems discussed above in the Background of the Invention. The present invention provides for a single feed path to accept both envelopes and tapes for printing a postal indicia thereon. This has the benefit of reducing the footprint of the overall mailing machine 10. Also, the present invention provides for a drive assembly 200 and a guide assembly 300 that adapt to fed both envelopes and tapes reliably through the print station 110.

Many features of the preferred embodiment represent design choices selected to best exploit the inventive concept as implemented in a mailing machine employing ink jet printing technology. However, those skilled in the art will recognize that various modifications can be made without departing from the spirit of the present invention. For example, the feed rollers 230 may be replaced by suitable O-ring or narrow belt feed devices. Similarly, the endless belt 214 and the pulleys 212 may be replaced by a plurality of suitable feed rollers. As another example, the inner support rail 320 may be eliminated completely if the outer support rail 360 is increased in width. However, in the preferred embodiment two support rails are employed to provide control across the width of the tape 24 without inducing an unnecessary amount of the drag on the tape 24.

Thus, those skilled in the art will readily be able to adapt the inventive concepts of the present invention to suit their own particular applications. Therefore, the inventive concept in its broader aspects is not limited to the specific details of the preferred embodiments but is defined by the appended claims and their equivalents.

What is claimed is:

1. A mailing machine for feeding a mailpiece and printing a postal indicia thereon, the mailing machine comprising:

drive means for feeding the mailpiece in a path of travel;

print means located adjacent to the path of travel to define a print station, the print means for printing the postal indicia on the mailpiece as the mailpiece is fed through the print station;

a wall parallel to the path of travel for registering a top edge of the mailpiece;

a shield located in the print station for registering a top surface of the mailpiece, the shield having a suitable opening to allow the print means to print on the top surface of the of the mailpiece; and guide means for biasing the top surface of the mailpiece against the shield, the guide means including:

a first support rail including a first top guide surface and a second top guide surface vertically spaced apart from the first top surface, the first support rail spaced apart transverse to the path of travel from the wall; and means for biasing the first support rail upward so that the mailpiece is fed between the shield and the first support rail as the mailpiece is fed through the print station; and wherein a first type of mailpiece having a width greater than a threshold value contacts the first top guide surface and a second type of mailpiece having a width less than the threshold value contacts the second top guide surface.

2. The mailing machine of claim 1 wherein:

the guide means further includes:

a second support rail including a top guide surface, the second support rail spaced apart transverse to the path of travel from the first support rail and located nearer to the wall than the first support rail; and means for biasing the second support rail upward so that the mailpiece is fed between the shield and the second support rail as the mailpiece is fed through the print station; and wherein the first type of mailpiece and the second type of mailpiece contact the top guide surface of the second support rail.

3. The mailing machine of claim 2 wherein:

the first support rail further includes a guide surface substantially parallel to the wall that extends from the second top surface so that the second type of mailpiece is captured between the wall and the guide surface so as to assist in registering the top edge of the second type of mailpiece along the wall.

4. The mailing machine of claim 3 wherein:

the guide surface is spaced about 1.5 inches from the wall.

5. The mailing machine of claim 1 wherein:

the first support rail further includes a guide surface substantially parallel to the wall that extends from the second top surface so that the second type of mailpiece is captured between the wall and the guide surface so as to assist in registering the top edge of the second type of mailpiece along the wall.

6. The mailing machine of claim 5 wherein:

the guide surface is spaced about 1.75 inches from the wall.

7. The mailing machine of claim 6 wherein:

the guide means further includes:

a second support rail including a top guide surface, the second support rail spaced apart transverse to the path of travel from the first support rail and located nearer to the wall than the first support rail; and means for biasing the second support rail upward so that the mailpiece is fed between the shield and the second support rail as the mailpiece is fed through the print station; and wherein the first type of mailpiece and the second type of mailpiece contact the top guide surface of the second support rail.

* * * * *